US007082653B1

(12) United States Patent
Sueppel

(10) Patent No.: US 7,082,653 B1
(45) Date of Patent: Aug. 1, 2006

(54) PICTURE FRAME AND CONTAINER FOR CREMATION ASHES

(76) Inventor: Brent E. Sueppel, 125 Melanie Dr., Lake Placid, FL (US) 33852

( * ) Notice: Subject to any disclaimer, the term of this patent is extended or adjusted under 35 U.S.C. 154(b) by 0 days.

(21) Appl. No.: 11/385,950

(22) Filed: Mar. 21, 2006

(51) Int. Cl.
*A61G 17/00* (2006.01)

(52) U.S. Cl. ..... 27/1; 40/722; 40/725

(58) Field of Classification Search ..... 27/1; D99/5; 40/124.5, 722, 724, 725, 729, 732, 40/737
See application file for complete search history.

(56) References Cited

U.S. PATENT DOCUMENTS

| | | | | |
|---|---|---|---|---|
| 4,199,848 | A | 4/1980 | Kohnert | |
| 5,174,054 | A * | 12/1992 | Politi | 40/737 |
| 5,197,213 | A * | 3/1993 | Borden | 40/737 |
| 5,230,127 | A | 7/1993 | Zukowski et al. | |
| 5,465,514 | A * | 11/1995 | Ulysse | 40/783 |
| 5,617,660 | A * | 4/1997 | Pollack | 40/606.17 |
| 5,625,933 | A | 5/1997 | Neuberger et al. | |
| 5,787,625 | A | 8/1998 | Yesbick | |
| 5,896,632 | A * | 4/1999 | Sturino | 27/1 |
| 5,950,287 | A | 9/1999 | Cacciatore et al. | |
| 5,950,288 | A | 9/1999 | Bach Lahor | |
| 6,170,136 | B1 | 1/2001 | Wilson-Brokl | |
| D449,418 | S | 10/2001 | Robinson | |
| 6,347,439 | B1 | 2/2002 | Bach Lahor | |
| 6,526,636 | B1 * | 3/2003 | Bernhardt | 27/1 |
| 6,532,634 | B1 | 3/2003 | Wilson-Brokl | |
| 6,550,172 | B1 * | 4/2003 | Korpai | 40/725 |
| 6,665,916 | B1 | 12/2003 | Santorello et al. | |
| 6,735,831 | B1 | 5/2004 | Greiwe et al. | |
| D492,079 | S * | 6/2004 | Feltman | D99/5 |
| 6,896,146 | B1 | 5/2005 | Corrado | |
| 2005/0144821 | A1 * | 7/2005 | Griesemer et al. | 40/546 |
| 2005/0246877 | A1 * | 11/2005 | Davis et al. | 27/1 |

FOREIGN PATENT DOCUMENTS

| | | | |
|---|---|---|---|
| JP | 08010117 | * | 1/1996 |
| JP | 2002028069 | * | 1/2002 |

* cited by examiner

*Primary Examiner*—William L. Miller
(74) *Attorney, Agent, or Firm*—Charles J. Prescott

(57) ABSTRACT

A unique combination of a picture frame for displaying a visual image of the deceased person along with a preferably tubular storage container which holds a quantity of the cremation remains of the deceased person within the perimeter structure of the picture frame itself. A hollow groove is formed into the picture frame perimeter into which the hollow storage container, preferably in the form of a closed rectangular loop, may be inserted and secured before or after being filled with the cremated ashes. A viewing port of those ashes within a hollow transparent segment of the storage container may also be provided. Alternately, a separate cremation ashes storage frame attachable to the back side of a conventional picture frame is also provided.

8 Claims, 3 Drawing Sheets

PICTURE FRAME AND CONTAINER FOR CREMATION ASHES

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the storage of cremation remains or ashes and more particularly to a picture frame display of a deceased person in combination with the storage of at least a portion of those cremation remains within the frame.

2. Description of Related Art

Cremation has become a very popular form of dealing with the deceased remains of a person or animal. Those cremation ashes are typically dealt with by spreading them over a sentimental area, retaining them in an urn, or burying them in a sacred or holy cemetery or burial place.

There have been a number of patented storage means which provide for additional unique and distinctive ways of dealing with those cremation remains.

U.S. Pat. Nos. 5,950,288 and 6,347,439 to Bach Lahor disclose a frame containing a sealed housing for ashes of a human or pet and a graphic element such as pictures. An apparatus for containing cremation ashes and displaying a photograph in the same compartment is taught by Cacciatore, et al. in U.S. Pat. No. 5,950,287.

Neuberger, et al. teaches a storage container for cremated remains and a panel insert for holding a decorative panel therein in U.S. Pat. No. 5,625,933. U.S. Pat. No. 6,665,916 to Santorello, et al. discloses a means to display cremated remains of humans or animals in a decorative and artistic fashion.

U.S. Pat. No. 5,787,625 to Yesbick teaches an air-chambered, weatherproof picture frame for attachment to an urn or gravesite monument and Wilson-Broki discloses a display in which cremated remains are added thereto in U.S. Pat. No. 6,532,634. U.S. Pat. No. 4,199,848 discloses a burial urn for storing cremated remains and displaying a memorial.

Other patents of interest are U.S. Pat. No. 6,896,146 to Corrado, U.S. Pat. No. 6,735,831 to Greiwe, et al., and U.S. D449,418 to Robinson.

The present invention provides a unique combination of a picture frame for displaying a visual image of the deceased person along with a hollow preferably tubular member which holds and stores a quantity of the cremation remains of the deceased person within the perimeter structure of the picture frame itself. A hollow groove is formed into the picture frame perimeter into which the hollow tubular member, preferably in the form of a closed rectangular loop, may be inserted and secured after being filled with the cremated ashes. A viewing port of those ashes within a transparent segment of the hollow ashes storage member may also be provided.

BRIEF SUMMARY OF THE INVENTION

This invention is directed to a picture frame for displaying a conventional photo, picture or indicia of a deceased person and a closable hollow member embedded or fitted into a cavity formed into the perimeter of the picture frame. The interior volume defined by the hollow preferably tubular member is fillable with a quantity of cremation ashes of the deceased. When sealed closed, the picture frame, with the cremation ashes stored within the hollow member, serves as a cremation urn and photo remembrance of the deceased. A small segment of the hollow member may be transparent and positioned in alignment with a viewing port formed into the perimeter of the picture frame for viewing of the ashes. Alternately, a separate cremation ashes storage frame attachable to the back side of a conventional picture frame is also provided.

It is therefore an object of this invention to provide a picture frame which viewably displays an image of a deceased person and stores a quantity of the cremated remains of that deceased person.

It is another object of this invention to utilize a standard picture frame which will display a viewable image, picture, photo or likeness of a deceased person and which will also store a hollow container into which cremated remains may be placed and stored within a groove formed into the back of the perimeter of the picture frame.

Yet another object of this invention is to provide a picture frame for displaying a viewable image of a deceased person which is attached to a separate perimeter cremated remains storage frame attachable to the back of a picture frame.

It is still another object of this invention is to provide a picture frame which viewably displays some indicia of a deceased person and stores in a fireproof container cremated remains of the deceased person.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
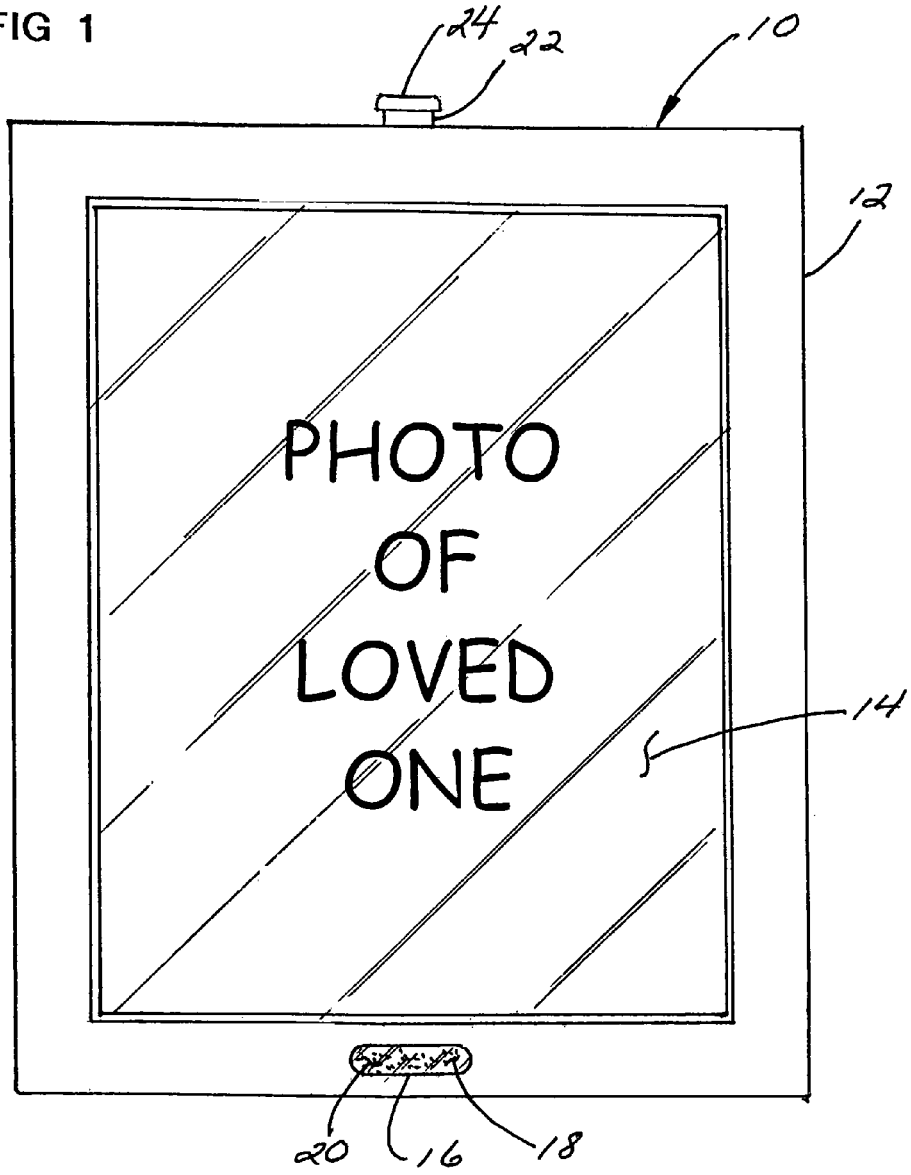
FIG. 1 is a front elevation view of the preferred embodiment of the invention.
Figure 2:
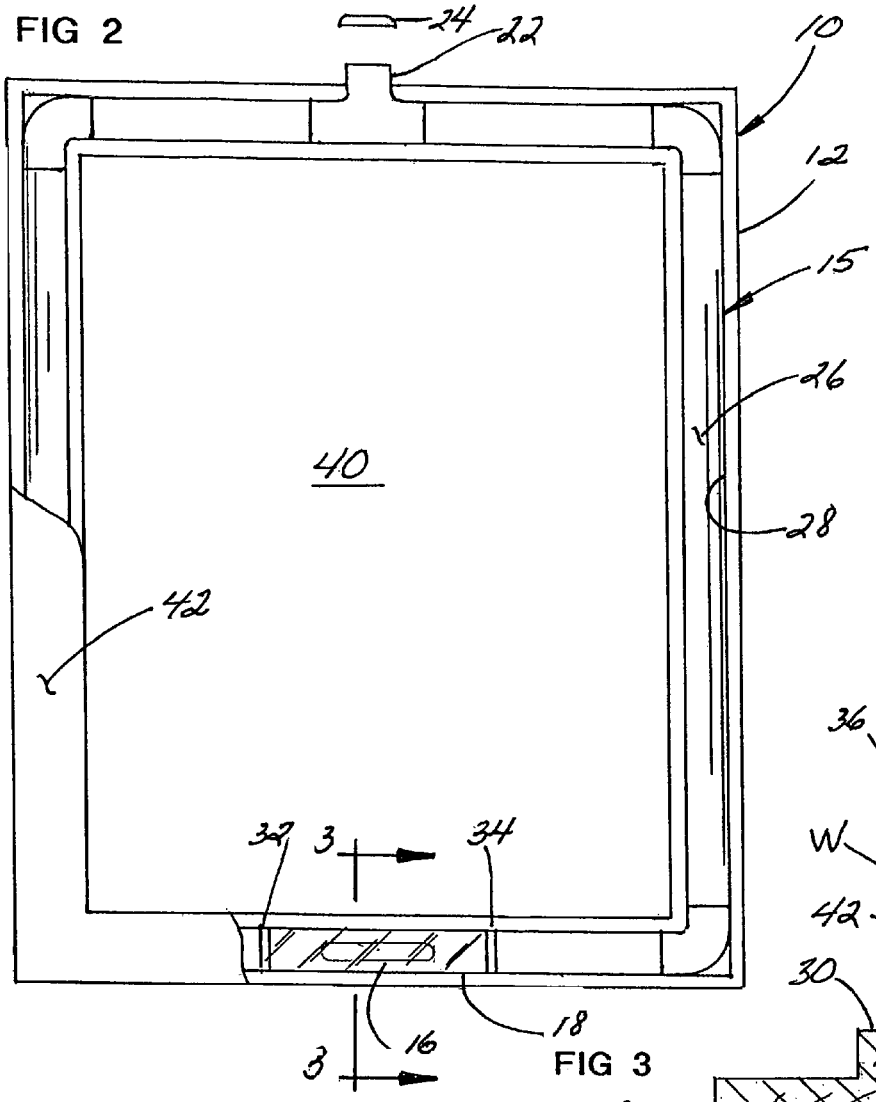
FIG. 2 is a partially broken rear elevation view of FIG. 1.
Figure 3:
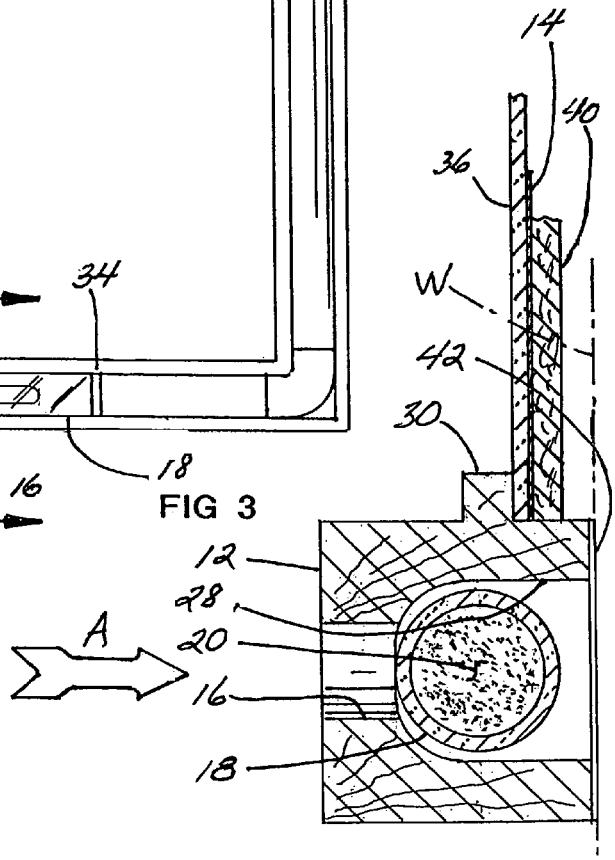
FIG. 3 is a cross sectional view in the direction of arrows 3—3 in FIG. 2.

Referring now to the drawings, the preferred embodiment of the invention is shown generally at numeral 10 in FIGS. 1–3 and includes a rectangular picture frame 12 having a rectangular perimeter of preferably wood or composite material, metal or other suitable material utilized to form such a picture frame 12. As best seen in FIG. 3, a photo 14 bearing viewable indicia of a deceased person such as a picture, photograph, drawing, sketch or likeness of that deceased person is sandwiched between a transparent glass plate 36 and a stiff cardboard backing 40. By this conventional arrangement, the photo 14 is protectively held behind the transparent glass plate 36 which abuts against an inwardly extending flange 30 and is held in this position by the backing member 40.

This invention 10 also includes a rectangularly configured hollow storage container 15 formed of suitable inert plastic or metallic tubular member 26 and having an openable port 22 made closeable and sealing of the interior volume by cap 24. Although shown as being visible in Figure, the port 22 and cap 24 are preferably concealed from view. To hold a larger quantity of cremated ashes or remains of a deceased person, the storage container 15 extends along substantially the entire rectangular perimeter of the picture frame 12 as best seen in FIG. 2.

In FIG. 3, each tubular member shown typically at 26 is positioned within a U-shaped groove 28 formed into the back surface of the picture frame 12 for easy insertion thereof after the cremated remains have been poured into the hollow interior through opening 22 and sealed by cap 24. By this arrangement, the cremated remains are concealably held within the storage container 15 within the cavity or groove 28 formed into the hidden or concealed side of the picture frame 12 when it is hung against a wall W. To further conceal the contents of groove 28, a paper, cardboard or fabric covering 42 is attached over this grooved back surface of the picture frame 12.

In this embodiment 10, the cremated remains are also preferably viewable through a transparent tubular segment 18 of the storage container 15. This tubular transparent segment 18 is connected at 32 and 34 to the mating unconnected ends of adjacent tubular members 26 as best seen in FIG. 2. A viewing port 16 is formed into the central front surface of the picture frame 12 in alignment and registry with the transparent hollow member 18 so that the cremated remains 20 may be viewed through viewing port 16 in the direction of arrow A while simultaneously viewing the photo 14 or other viewable indicia of the deceased person.

Figure 4:
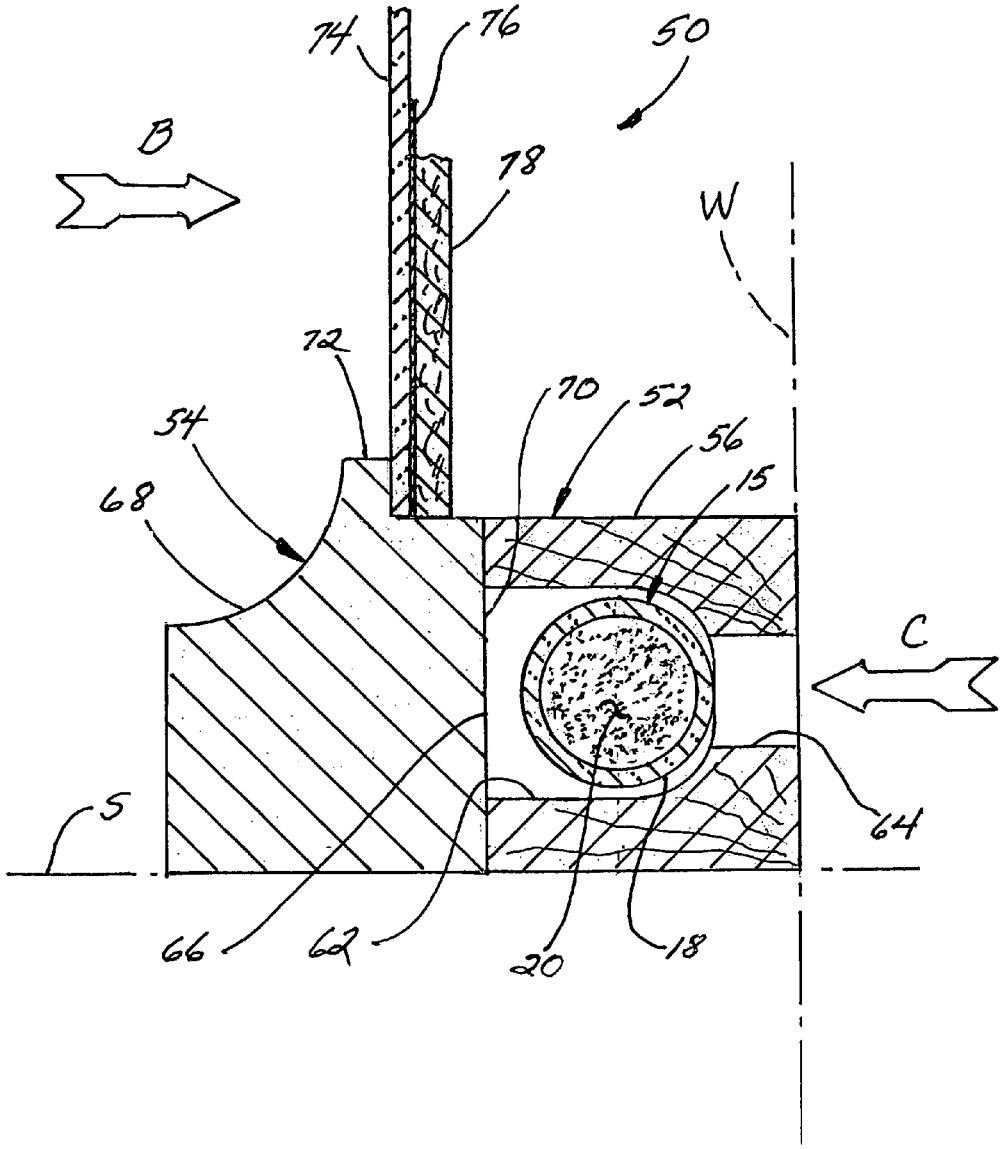
FIG. 4 is a cross sectional view similar to that of FIG. 3 showing an alternate embodiment of the invention.

Referring now to FIG. 4, an alternate embodiment of the invention is there shown generally at numeral 50 and provides a conventional picture frame shown at 54, along with a hidden cremation ashes storage frame 52. As previously described, the picture frame 54 includes a wooden or other suitable perimeter frame 68 which supports against its inner flange 72 a picture 76 of the deceased person protectively covered by a front glass panel 74 and held thereagainst by a cardboard or stiffening panel 78.

The cremation ashes frame 52 includes a perimeter frame 56 also preferably formed of wood material which is substantially similar in shape and dimension to that of the picture frame 68. A groove 62 is formed into the front surface 66 of the perimeter frame 56 to receive the tubular storage container 15 as previously described which stores a quantity of cremation ashes 20 therein. By attachment of the front surface 66 of the cremation ashes frame 56 against the back surface 70 of the picture frame 68, the tubular storage container 15 is held and concealed from view.

In this embodiment 50, a transparent segment 18 is also provided along one section of the storage container 15 as previously described so that the ashes 20 may be viewed through a viewing port 64 formed into the back surface of the cremation ashes frame 56 in the direction of arrow C when the invention 50 has been removed from positioning against a wall W or is supported atop a flat horizontal surface S. By this arrangement of FIG. 4, a conventional picture frame 54 may be utilized, in combination with a specially fabricated cremation ashes frame 52, to enhance marketability of the invention 50.

A preferred feature of the present invention is that the cremated ashes or remains will be held protected in the event of a fire. Therefore, although plastic may be selected where this feature is not desired, to obtain this feature, the tubular member 26 of the storage container 15 is preferably made of material such as copper, steel or other metallic material or glass material which has a high melt temperature. The transparent segment 18 being preferably formed of glass material, fulfills this preferred requirement.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A combination picture frame and cremation ashes storage container comprising:

said picture frame for holding and displaying a portrait, photo or likeness of that of a cremated deceased person to be viewable from a front side of said frame;

said storage container including an elongated hollow tubular member defining an interior volume and positioned into a concealed groove formed into a back surface of a perimeter of said picture frame, said storage container having a closable opening for introducing and storing a quantity of cremation ashes of the deceased into said interior volume and a covering attached over said back surface of said picture frame to conceal said groove.

2. The combination of claim 1, further comprising:

a viewing port formed through one edge of said picture frame;

a transparent hollow section of said storage container cooperatively positioned with said viewing port wherein a portion of the cremation ashes may be viewed through said viewing port.

3. The combination of claim 2, wherein:

said storage container is generally coextensive with the perimeter of said picture frame.

4. In combination, a picture frame and a cremation ashes frame, comprising:

said picture frame for holding and displaying a portrait, photo or likeness of that of a cremated deceased person to be viewable from a front side of said picture frame;

said cremation ashes frame including a perimeter having a front and back surface and substantially similar in size to, and matably connectable against, a back surface of a perimeter of said picture frame;

a groove formed into said front surface of said perimeter of said cremation ashes frame;

an elongated hollow storage container defining an interior volume and positioned or positionable into said groove, said storage container having a closable opening for introducing and storing a quantity of cremation ashes of the deceased into said interior volume;

said groove and said storage container being substantially covered and concealed when said frames are connected together in back-to-front fashion.

5. The combination as set forth in claim 4, further comprising:

a viewing port formed through said back surface of said cremation ashes frame;

said storage container including a hollow transparent portion which is aligned with said viewing port wherein the cremation ashes in said transparent portion are viewable through said viewing port.

6. The combination as set forth in claim 5, wherein:

said storage container is generally coextensive with the perimeter of said cremation ashes frame.

7. A picture frame for assembly viewing a portrait, picture or photo of a deceased person and for storing cremation ashes of the deceased, comprising:

a picture frame for holding and displaying a portrait, photo or likeness of that of a cremated deceased person to be viewable from a front side of said picture frame;

a cremation ashes frame including a perimeter having a front and back surface and being substantially similar in size to, and matably connectable against, a back surface of a perimeter of said picture frame;

a groove formed into said front surface of said perimeter of said cremation ashes frame;

an elongated hollow storage container defining an interior volume and positioned or positionable into said groove, said storage container having a closable opening for introducing and storing a quantity of the cremation ashes of the deceased into said interior volume;

a viewing port formed through said back surface of said cremation ashes frame;

said storage container including a hollow transparent portion which is aligned with said viewing port wherein the cremation ashes in said transparent portion are viewable through said viewing port;

said storage container is generally coextensive with the perimeter of said cremation ashes frame.

8. The picture frame assembly as set forth in claim 7, wherein:

said storage container is formed of substantially fire-proof material.

* * * * *